United States Patent [19]

Mersmann

[11] Patent Number: 5,063,620

[45] Date of Patent: Nov. 12, 1991

[54] BATH WITH SWIRL NOZZLES

[75] Inventor: Heinz-Werner Mersmann, Ahlen, Fed. Rep. of Germany

[73] Assignee: Franz Kaldewei GmbH & Co., Fed. Rep. of Germany

[21] Appl. No.: 536,614

[22] PCT Filed: Dec. 24, 1988

[86] PCT No.: PCT/DE88/00782

§ 371 Date: Sep. 10, 1990

§ 102(e) Date: Sep. 10, 1990

[87] PCT Pub. No.: WO89/06120

PCT Pub. Date: Jul. 13, 1989

[30] Foreign Application Priority Data

Jan. 9, 1988 [DE] Fed. Rep. of Germany ..... 3800400

[51] Int. Cl.[5] ..... A61H 33/02

[52] U.S. Cl. ..... 4/542; 4/544

[58] Field of Search ..... 4/492, 541, 542, 544

[56] References Cited

U.S. PATENT DOCUMENTS

| | | | |
|---|---|---|---|
| 4,665,572 | 5/1987 | Davidson et al. | 4/492 |
| 4,853,987 | 8/1989 | Jaworski | 4/542 |

FOREIGN PATENT DOCUMENTS

| | | | |
|---|---|---|---|
| 0209646 | 4/1986 | European Pat. Off. . | |
| 1566497 | 10/1970 | Fed. Rep. of Germany . | |
| 2209507 | 9/1973 | Fed. Rep. of Germany . | |
| 2319902 | 11/1974 | Fed. Rep. of Germany . | |
| 2408270 | 8/1975 | Fed. Rep. of Germany . | |
| 2417708 | 10/1975 | Fed. Rep. of Germany . | |
| 8625515 | 9/1986 | Fed. Rep. of Germany . | |
| 3716683 | 5/1987 | Fed. Rep. of Germany . | |
| 3640252 | 6/1988 | Fed. Rep. of Germany | 4/541 |
| 8804977 | 7/1988 | Fed. Rep. of Germany | 4/542 |
| 1134038 | 4/1957 | France . | |
| 492410 | 3/1954 | Italy | 4/544 |
| 532405 | 8/1955 | Italy | 4/544 |
| 8802541 | 8/1989 | Netherlands | 4/542 |

OTHER PUBLICATIONS

Prospectus from Hugo Lahme GmbH, 2/22/78.

*Primary Examiner*—Henry J. Recla
*Assistant Examiner*—Robert M. Fetsuga
*Attorney, Agent, or Firm*—Speckman & Pauley

[57] ABSTRACT

A whirlpool bathtub having devices for generating jets of water and/or air, which can be directed into an interior of a tub from several positions on a side wall and/or bottom wall of the tub. An individual, drivable device generates a water and/or air jet which corresponds to each of the positions. The device is mounted within the tub side wall and has a driving force from a direction of an exterior of the tub. A nozzle housing has a pump chamber with an impeller mounted within the pump chamber, which is sealed towards the exterior of the tub. The pump chamber terminates toward the tub interior with a nozzle cover having suction openings and nozzle openings. The impeller takes in water from the tub interior through suction opening of the nozzle cover and supplies the water from the pump chamber radially through directed feed conduits to at least one conduit in the nozzle cover which begins at the wall of the pump chamber, facing a peripheral side of the impeller, and ends in at least one nozzle opening of the nozzle cover. Other nozzle covers of varied numbers and varied designs of the conduits and the nozzle openings can be connected with the nozzle housing.

18 Claims, 2 Drawing Sheets

BATH WITH SWIRL NOZZLES

BACKGROUND OF THE INVENTION

This invention relates to a whirlpool bathtub with devices for generating jets of water and/or air, which can be directed into the interior of the tub from several positions on the wall and/or the bottom of the tub. An individual, drivable device for generating a water and/or air jet is assigned to each one of these positions, which is placed on the tub wall or the tub bottom, or built into the tub wall or the tub bottom and which can be provided with a driving force from the direction of the exterior of the tub.

The individual assignment of one device generating a water and/or air jet per position on the tub wall and/or on the tub bottom has an advantage of not requiring the disposition of water feed tube systems underneath the built-in whirlpool bathtub. Therefore the device is easy to clean and thus to maintain in a sanitary condition. The individual devices for generating a water and/or air jet are easily accessible from the interior of the tub for removal and cleaning.

SUMMARY OF THE INVENTION

It is one object of the present invention to provide a simple and high-output device for generating a water jet for a whirlpool bathtub of the type mentioned above, where the shape of the jet given off can be varied by a simple adaptation of a part and where it is simple to add an air jet to the strong water jet.

This object is achieved with this invention in that a nozzle housing with a pump chamber is associated with each position, in which an impeller of a pump is rotatably seated. The impeller takes in water from the tub interior via suction openings of a nozzle cover which closes off the nozzle housing towards the tub interior. The impeller guides the water taken in from the pump chamber to at least one conduit in the nozzle cover which ends in at least one nozzle opening directed to the tub interior.

Inside the nozzle housing the device contains only the impeller of a pump, which can be driven from the exterior of the tub. Water is taken in by the pump and is returned to the tub interior as a strong jet or a plurality of strong jets through conduits of the nozzle cover. In this connection, it is possible to determine the shape of the water jet by the design, for example the guidance and shaping of the conduits of the nozzle cover, alone.

In accordance with an embodiment, the impeller axially takes in water and has radially-directed feed conduits. The conduit or the conduits in the nozzle cover begin on the wall of the pump chamber of the nozzle housing or the nozzle cover facing the peripheral side of the impeller.

After removing the nozzle cover it is easy to clean the pump. It is also possible to easily clean and maintain a sanitary condition of the nozzle cover with the conduit or the conduits to the nozzle opening or nozzle openings.

The type of the water jet discharged is a function of the design of the nozzle opening, such as a narrow, arc-shaped slit. This fan stream is preferably used for a soft massage above the tub bottom.

In accordance with another embodiment, the water jet can be discharged in such a way that a plurality of nozzle openings in the shape of bores with small diameters are disposed on a circle, which are connected with the pump chamber by means of a common conduit or individual conduits of the nozzle cover. A plurality of round jets are thus generated, which are used for a normal massage.

In a single nozzle opening, round in diameter, which is connected with the pump chamber through a single conduit of the nozzle cover, a single, strong water jet is emitted, which can be used for a directed massage.

In accordance with an embodiment, the structural design of the nozzle housing is such, that the nozzle housing is assembled from the nozzle cover and a motor support flange. The nozzle covers have different nozzle openings which can be connected in the same way and interchangeably with the motor support flange or with a housing ring which can be inserted in an opening in the tub wall or the tub bottom. The motor support flange itself or the housing ring receiving the motor support flange is sealingly inserted in the opening of the tub wall or the tub bottom. Then the nozzle covers can be assigned to the positions on the tub wall or the tub bottom in any way and can also be easily applied in a different assignment.

The sealed installation of the nozzle housing into the tub wall or the tub bottom is provided in accordance with an embodiment in such a way, that the housing ring is supported by means of a flange on the portion of the tub wall or the tub bottom surrounding the opening. The housing ring is inserted into the opening with a sealing collar, and a nut screwed onto an outer thread of the housing ring, preferably with a washer interposed, tightly fixes the housing ring in the opening.

If the nozzle cover surrounds the flange of the housing ring with a border and in the area of overlap a seal ring seals the nozzle housing formed by the nozzle cover and housing ring and/or motor support flange, the nozzle cover tightly seals the nozzle housing.

If, besides the housing ring, a motor support flange is provided for the nozzle housing, the nozzle housing will be tightly sealed towards the outside of the tub when the motor support flange is inserted into the housing ring and is sealed by means of at least one seal ring in the overlap area.

In accordance with an embodiment, the drive of the impeller of the pump is provided such that on the side of the motor support flange facing away from the impeller an electric motor is fixed, the motor shaft of which is brought through the motor support flange into the pump chamber and is connected with the impeller fixed against relative rotation. The electric motor is covered by a housing cup which is connected with the housing ring fixed in the opening of the tub wall or the tub bottom. In this case, the electric motor with the motor support flange can be replaced from the side of the interior of the tub without it being necessary to remove the housing cup and the housing ring from the opening of the tub wall or the tub bottom.

If, in accordance with a further embodiment the overlap area between the housing ring and the motor support flange a peripheral annular conduit is formed, which is accessible through the through-bore of a radially connected hose connecting stub, and beginning at the annular conduit, air conduits are imbedded in the motor support flange and the flange of the housing ring, which are connected through air conduits in the nozzle cover with the conduit coming from the pump chamber and end as Venturi openings in the area of the nozzle openings, an air jet or a plurality of air jets are mixed with the water jet or water jets in the area of the nozzle cover. If a plurality of nozzle openings are provided in the nozzle cover, the admixing of the air jets that the air conduit or air conduits of the nozzle cover end in an air chamber, where individual conduits with Venturi openings branch off.

BRIEF DESCRIPTION OF THE DRAWINGS

The invention will be explained in detail by means of an exemplary embodiment shown in the drawings wherein.

DESCRIPTION OF PREFERRED EMBODIMENTS

Figure 1:
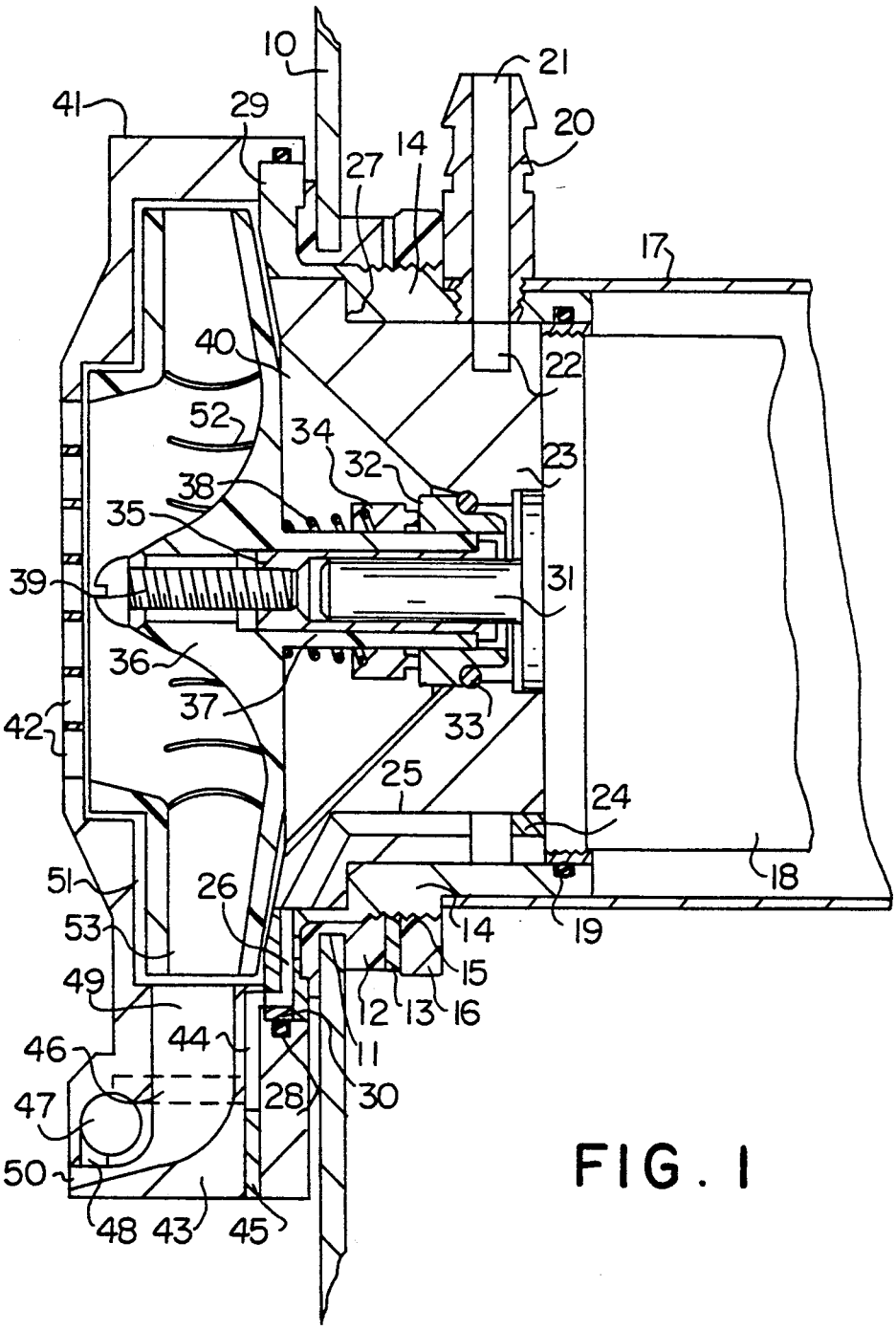
FIG. 1 is a sectional view of a pump for generating a water jet, to which an air jet is added, installed in an opening of the tub wall.

As shown by the section in accordance with FIG. 1, the individual device for generating a water jet with an added air jet is installed in an opening 11 of the tub wall 10. In the same way installation can also be made in an opening of the tub bottom. First a sealing collar 12 is inserted in the opening 11, which partially covers both sides around the opening 11 with flanges. The housing ring 14 is inserted in the sealing collar 12 and is supported on the inside of the tub wall 10 with a flange 29. The nut 16 is screwed on the outer thread 15 of the housing ring 14, with the washer 13 interposed, so that the housing ring 14 is tightly seated in the opening 19.

The motor support flange 23 closing off the nozzle housing towards the exterior of the tub is fixed in the housing ring 14. For sealing, the two sealing rings 19 and 27 are inserted in the overlap area between the housing ring 14 and the motor support flange 23. On the side facing the interior of the tub, the motor support flange 23 has an opening 40 forming a part of the pump chamber and receiving the elements for connecting the impeller 36 of the pump with the motor shaft 31 of the electric motor 18. The electric motor 18 is contained in the housing cup 17, which is connected with the housing ring 14 by means of its open side. The motor shaft 31 extends through a central receptacle of the motor support flange 23. The axial face seals 32 and 34, along with the seal ring 33, seal the extended motor shaft 31. The shaft bushing 35 is fastened, fixed against relative rotation, on the motor shaft 31. The impeller 36 is fastened on the shaft bushing 35 by means of the seating sleeve 37, and the screw 39 represents the connection, fixed against relative rotation, between the impeller 36 and the shaft bushing 35. The impeller 36 is supported on the axial face seal 34 by means of the helical spring 38. In the direction towards the interior of the tub, the nozzle cover 41 closes off the nozzle housing. The nozzle cover 41 surrounds the flange 29 of the housing ring 14 with a border, the sealing ring 28 sealing the separation between the nozzle cover 41 and the housing ring 14 in the overlap area.

The nozzle cover 41 defines the pump chamber 51, in which the impeller 36 is positioned. The impeller 36, having the vanes 52 and the radial feed conduits 53, axially takes in water through the suction openings 42 in the nozzle cover 41 and supplies the water taken in through the radial feed conduits 53 to the conduit 49 in the nozzle cover 41 ending in the nozzle opening 50 which is directed towards the tub interior.

The conduit 49 extends from the wall of the pump chamber 51 which surrounds the circumference of the impeller 36. The nozzle cover 41 may have a single conduit 49 ending in a single nozzle opening 50. However, a plurality of conduits 49 may extend to various nozzle openings 50′ over the peripheral area of the pump chamber 51.

Figure 4:
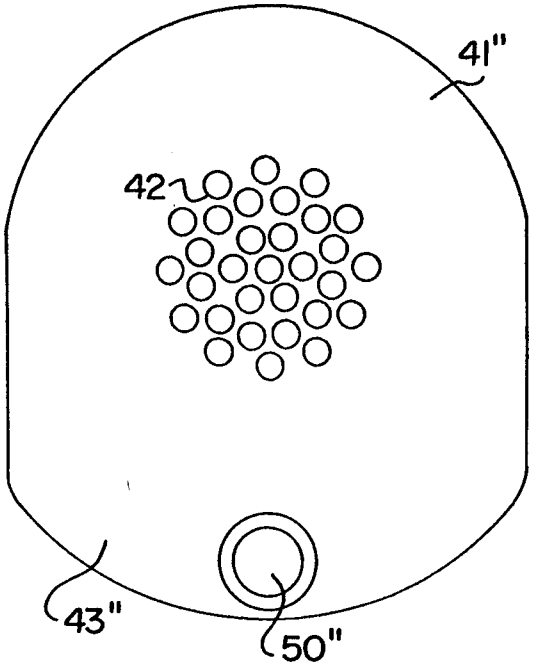
FIG. 4 is a front view of a nozzle cover with a single round nozzle opening having a large cross section.
Figure 3:
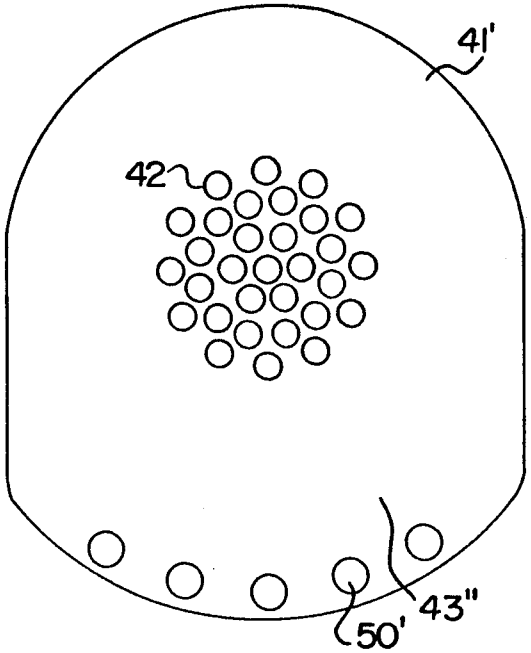
FIG. 3 is a front view of a nozzle cover with a plurality of round nozzle openings arranged in a circle.
Figure 2:
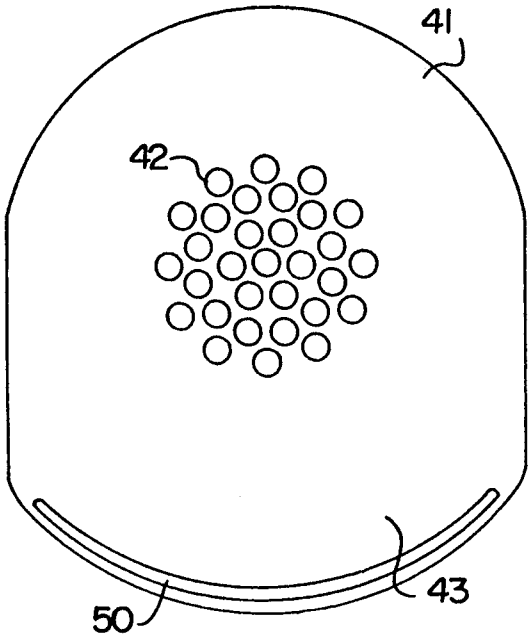
FIG. 2 is a front view of a nozzle cover with a slitted and arc-shaped nozzle opening.

FIGS. 2 to 4 show three different nozzle covers 41, which are identical in the configuration of their connection with the housing ring 14 and in the design of the corresponding pump chamber 51. The nozzle covers 41 are only different in the disposition of the conduit 49 or of the conduits and the nozzle openings 50, 50′ and 50″. The suction openings 42 are always centrally positioned, so that the impeller 36 takes in the water axially and discharges it radially. The conduit 49 or the conduits extend from the wall of the pump chamber 51 which surrounds the impeller 36 and, in the embodiment in accordance with FIG. 2, lead in the projecting part 43, serving as an air guidance block, to the slitted, arc-shaped nozzle opening 50. In the embodiment in accordance with FIG. 3, a plurality of conduits of the nozzle cover 41 end in round nozzle openings 50′ located on a circle. The cross section is comparatively small, so that a plurality of water jets exit from the nozzle openings 50′. In the embodiment in accordance with FIG. 4, only a single round nozzle opening 50″ is installed in the nozzle cover 41, which is preferably connected through a single conduit 49 with the pump chamber 51 and, because of its large cross section, results in a strong water jet.

As shown in the section in accordance with FIG. 1, a circumferential annular conduit 22 may be formed in the overlap area between the housing ring 14 and the motor support flange 23, if a groove is cut in the periphery of the motor support flange 23 between the seal rings 19 and 27. The hose connecting stub 20 is radially inserted in the housing ring 14, the through-bore 21 of which ends in the annular conduit 22. Air conduits 25 of the motor support flange 23 are connected with air conduits 26 in the flange 29 of the housing ring 14, and the latter in turn with air conduits 44 and 46 of the nozzle cover 41. The air conduit 46 supplies the air chamber 47 in the nozzle cover 41. Conduits with Venturi openings 48 extend from the air chamber 47 and are located in the area of the nozzle openings 50, 50′ and 50″. Based on the Venturi principle, the water jet flowing in the conduits 49 or the channels draws in air through the Venturi openings 48, which is mixed with the water jet. Thus a water jet mixed with air is supplied to the interior of the tub. One end of the air conduits 25, 26 and 44 is closed with stoppers 24, 30 and 45. As a result, they can be easily cut in the motor support flange 23, the flange 29 of the housing ring 14 and the nozzle cover 41 in the form of bores.

When the electric motor 18 operates, the impeller 36 axially draws water out of the interior of the tub and feeds it under pressure via the radial feed conduits 53 to the conduit 49 in the nozzle cover 41, which further narrows in the direction of the nozzle opening 50 in order to provide a strong water jet. Suction air reaches the air chamber 47 through the through-bore 21 of the hose connecting stub 20, the annular conduit 22 and the air conduits 25, 26, 44 and 46, from where conduits forming the Venturi openings 48 branch off. Based on the Venturi principle, the water jet or water jets in the conduits 49 or the conduits of the nozzle cover 41 draws in air, which mixes with the water jet or the water jets, when passing the Venturi openings 48. In connection with this care should be taken to connect a hose to the hose connecting stub 20, the open end of which is located above the maximum water level in the bathtub, so that no water can flow off through the Venturi openings 48, the air conduits 46, 44, 26 and 25, the annular conduit 22 and the through-bore 21 of the hose connecting stub 20, when the pump is shut off.

Once the nozzle cover 41 has been removed, it is not only possible to remove the impeller 36 of the pump, but it is also possible to remove the electric motor 18 connected with the motor support flange 23 from the housing ring 14 and the housing cup 17 connected with it. All devices for generating the water and/or air jet thus can be easily cleaned and easily repaired or exchanged in case of required maintenance. If the electric motor 18 is switched off, no water remains in the device, because all conduits 49 and the air conduits 25, 26, 44 and 46 are automatically drained. By means of the rotational speed of the electric motor 18 the intensity of the water jet or the water jets can be adjusted in the most easy manner, and the electric motors 18 of the devices of the whirlpool bathtub can be controlled simultaneously and/or individually in order to vary the mode of operation of the whirl system.

I claim:

1. In a whirlpool bathtub having devices generating jets of at least one of water and air which can be directed into an interior of a tub from several positions on at least one of a side wall and a bottom wall of the tub, where one individual, drivable device of said devices corresponds to each said position, said device being mounted within the tub side wall and includes driving means positioned exterior of the tub and further includes a nozzle housing having a pump chamber and an impeller positioned within the nozzle housing and operatively connected to the driving means, the pump chamber being sealed watertight towards the exterior of the tub and opening towards the tub interior, the nozzle housing further having a nozzle cover with centrally positioned suction openings and peripherally positioned nozzle means, the improvement comprising:

the impeller (36) axially takes in water from the tub interior through the suction openings and supplies the water radially through feed conduit means (53) to the nozzle means in the nozzle cover (41).

2. In a whirlpool bathtub in accordance with claim 1, wherein the nozzle means (50) includes a nozzle opening in the form of a narrow, arc-shaped slit (50).

3. In a whirlpool bathtub in accordance with claim 1, wherein the nozzle means includes a nozzle opening in the form of a plurality of bores (50') each having a relatively small diameter and which are positioned in a circle pattern, and the bores (50') are connected with the feed conduit means (53) by at least one conduit (49) formed in the nozzle cover (41).

4. In a whirlpool bathtub in accordance with claim 1, wherein the nozzle means includes a single nozzle opening (50'') round in cross section and being connected with the feed conduit means (53) through a single conduit (49) formed in the nozzle cover (41).

5. In a whirlpool bathtub in accordance with claim 4, wherein the nozzle housing comprises the nozzle cover (41) and a motor support flange (23) sealingly mounted in a housing ring (14) which in turn is sealingly mounted in a wall opening (11) in one of the tub side wall (10) and the tub bottom wall.

6. In a whirlpool bathtub in accordance with claim 5, wherein the motor support flange (23) is sealing mounted in the housing ring (14) by at least one seal ring (19, 27).

7. In a whirlpool bathtub in accordance with claim 5, wherein the housing ring (14) is supported by a flange (29) surrounding and engaging a portion of the interior surface of one of the tub side wall (10) and the tub bottom wall, the housing ring (14) is sealingly mounted in the wall opening (11) with a sealing collar (12), and a nut (16) mating with an outer thread (15) of the housing ring (14) with a washer (13) interposed therebetween to tightly fix the housing ring (14) in the wall opening (11).

8. In a whirlpool bathtub in accordance with claim 7, wherein the nozzle cover (41) surrounds the flange (29) of the housing ring (14) with a border and a seal ring (28) seals the nozzle cover (41) to the housing ring (14).

9. In a whirlpool bathtub in accordance with claim 8, wherein the motor support flange (23) is sealingly mounted in the housing ring (14) by at least one seal ring (19, 27).

10. In a whirlpool bathtub in accordance with claim 9, wherein the driving means includes an electric motor (18) mounted on a side of the motor support flange (23) opposite the impeller (36), a motor shaft (31) of the electric motor (18) extends through an aperture in the motor support flange (23) and into the pump chamber (51) and is fixedly connected with the impeller (36), and a housing cup (17) encloses the electric motor (18) and is connected with the housing ring (14).

11. In a whirlpool bathtub in accordance with claim 10, wherein an annular groove is formed in an exterior surface of the motor support flange (23) and is closed by the housing ring (14) to form a peripheral annular conduit (22), a through-bore (21) is formed in the housing ring (14) in communication with the annular conduit (22) and a hose connecting stub (20) is mounted in the through-bore (21), and first air conduits (25, 26) are formed in the motor support flange (23) and the flange (29) of the housing ring (14) and in communication with the annular conduit (22), the first air conduits (25, 26) being connected with second air conduits (44, 46) formed in the nozzle cover (41) which are in communication with the single conduit (49) in the nozzle cover (41) and which end as Venturi openings (48) near the nozzle means (50, 50', 50'').

12. In a whirlpool bathtub in accordance with claim 11, wherein the nozzle means of the nozzle cover (41) includes an air chamber (47) in communication with the Venturi openings (48).

13. In a whirlpool bathtub in accordance with claim 1, wherein the nozzle housing comprises the nozzle cover (41) and a motor support flange (23) sealingly mounted in a housing ring (14) which in turn is sealingly mounted in a wall opening (11) in one of the tub side wall (10) and the tub bottom wall.

14. In a whirlpool bathtub in accordance with claim 12, wherein the housing ring (14) is supported by a flange (29) surrounding and engaging a portion of the interior surface of one of the tub side wall (10) and the tub bottom wall, the housing ring (14) is sealing mounted in the wall opening (11) with a sealing collar (12), and a nut (16) mating with an outer thread (15) of the housing ring (14) with a washer (13) interposed therebetween to tightly fix the housing ring (14) in the wall opening (11).

15. In a whirlpool bathtub in accordance with claim 13, wherein the nozzle cover (41) surrounds the flange (29) of the housing ring (14) with a border and a seal ring (28) seals the nozzle cover (41) to the housing ring (14).

16. In a whirlpool bathtub in accordance with claim 12, wherein the driving means includes an electric motor (18) mounted on a side of the motor support flange (23) opposite the impeller (36), a motor shaft (31) of the electric motor (18) extends through an aperature in the motor support flange (23) and into the pump chamber (51) and is fixedly connected with the impeller (36), and a housing cup (17) encloses the electric motor (18) and is connected with the housing ring (14).

17. In a whirlpool bathtub in accordance with claim 12, wherein an annular groove is formed in an exterior surface of the motor support flange (23) and is closed by the housing ring (14) to form a peripheral annular conduit (22), a through-bore (21) is formed in the housing ring (14) in communication with the annular conduit (22) and a hose connecting stub (20) is mounted in the through-bore (21), and first air conduits (25, 26) are formed in the motor support flange (23) and the flange (29) of the housing ring (14) and in communication with the annular conduit (22), the first air conduits (25, 26) being connected with second air conduits (44, 46) formed in the nozzle cover (41) which are in communication with the nozzle means and which end as Venturi means openings (48) near the nozzle means (50, 50', 50'').

18. In a whirlpool bathtub in accordance with claim 1, wherein the nozzle means of the nozzle cover (41) includes an air chamber (47) in communication with Venturi openings (48) formed in the nozzle cover.

* * * * *